United States Patent [19]

Bourlet

[11] 3,982,676

[45] Sept. 28, 1976

[54] DEVICE FOR HANDLING CARTRIDGE MAGAZINES AND SUCHLIKE

[75] Inventor: Maurice V. Bourlet, Liege, Belgium

[73] Assignee: Fabrique Nationale Herstal S. A., Herstal-lez-Liege, Belgium

[22] Filed: Aug. 13, 1974

[21] Appl. No.: 497,073

[30] Foreign Application Priority Data

Sept. 28, 1973 Belgium ..... 805427

[52] U.S. Cl. ..... 224/45 R; 42/90; 224/15

[51] Int. Cl.[2] ..... F42B 39/00

[58] Field of Search ..... 42/87, 88, 90; 89/33 R, 89/33 B, 33 BA, 33 BB, 33 BL, 34; 224/0.5, 5 R, 5 MC, 13, 14, 15, 16, 17, 18, 20, 45 R, 45 G, 45 S; 211/49 D; 312/42, 60, 71

[56] References Cited

UNITED STATES PATENTS

| | | | |
|---|---|---|---|
| 350,098 | 10/1886 | Amodeo-Salvator | 89/33 BC |
| 2,212,129 | 8/1940 | Rust | 211/49 D |
| 3,210,787 | 10/1965 | Allsop | 224/45 S |

*Primary Examiner*—Stephen C. Bentley
*Attorney, Agent, or Firm*—Bacon & Thomas

[57] ABSTRACT

The invention pertains to a device for packing and handling cartridge magazines or suchlike, characterized by the fact that it mainly consists of a straight portion of some strong section of which the two longitudinal edges are bent over in U-shape; one of the ends of the section being provided with a retractable flap in one sense, and the other end being foreseen with a hinged handle.

6 Claims, 7 Drawing Figures

DEVICE FOR HANDLING CARTRIDGE MAGAZINES AND SUCHLIKE

This invention relates to the problem of handling all sorts of magazines, such as namely cartridge magazines or cases, for instance for cartridge belts, chargers in boxes or others.

More generally, this invention concerns an extremely simple, sturdy, compact and cheap means for packing and handling such stacked elements.

More particularly still, the invention concerns the packing and handling of such magazines which have the possibility of being stacked, such magazines being of an overall prismatic shape of which one of the side surfaces is provided with a hooking on strip generally consisting of a rectangular platelet, two parallel sides of which are bent up so as to form attachment ledges.

The device according to the invention has the further advantage of offering the possibility of being put into operation with utmost facility and to be suitable for re-use, so that its adoption is economical.

This device is characterized by the fact that it mainly consists of a straight portion of a rigid sectional material of which the two longitudinal edges are bent back in U-shape; one of the ends of this sectional strip being provided with a flap which is retractable in one direction, and the other end being provided with a hinged handle.

This general arrangement may of course be completed by subsidiary devices.

The shape and dimensions of the various constituent elements are essentially variable according to the application under consideration.

Without any attempt at limitation, a form of embodiment is described hereinafter, with reference to the appended drawings in which.

Figure 1:
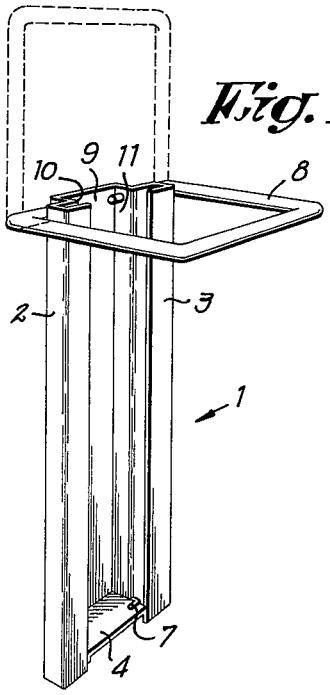
FIG. 1 shows a perspective front view of a device according to the invention.
Figure 2:
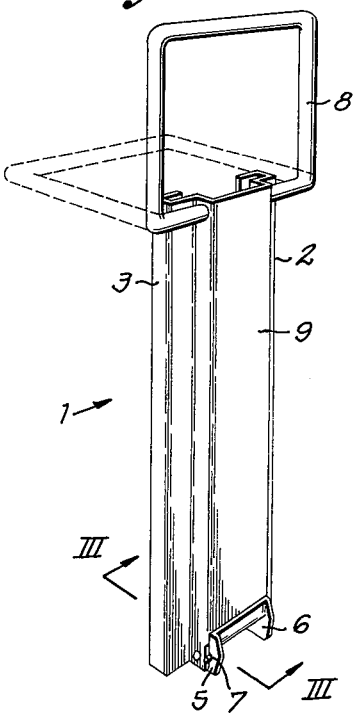
FIG. 2 shows a rear perspective view of same.
Figure 3:
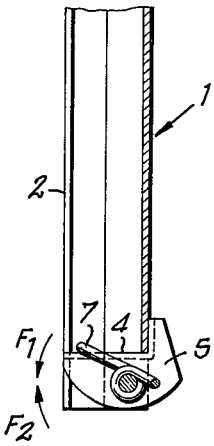
FIG. 3 shows a section according to line III—III of FIG. 2.
Figure 4:
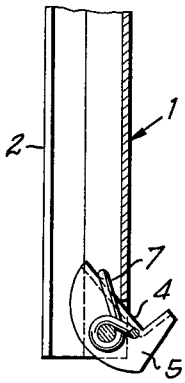
FIG. 4 is similar to FIG. 3, the flap being shown in an intermediate position.
Figure 5:
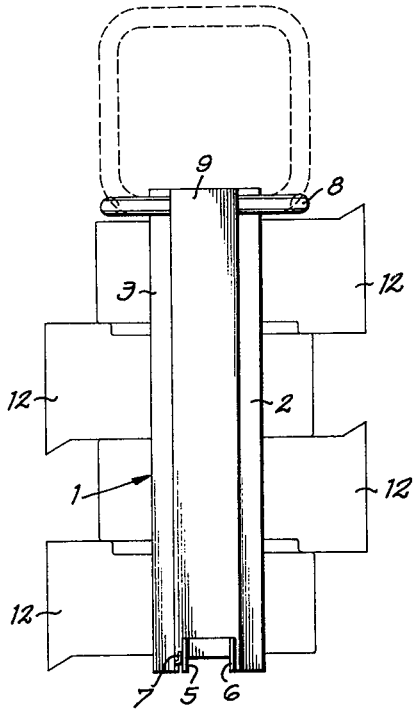
FIG. 5 shows a rear view of the device according to the invention, unto which a stack of magazines is attached.
Figure 6:
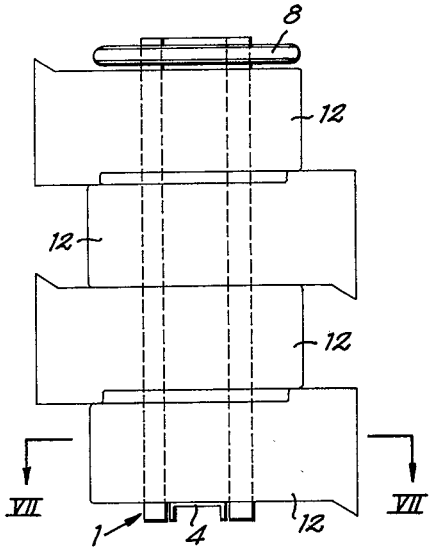
FIG. 6 is a front view of the device of FIG. 5.
Figure 7:
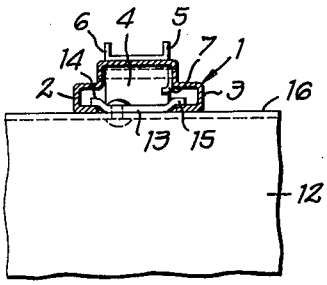
FIG. 7 shows a section according to line VII—VII in FIG. 6.

In this form of embodiment, the device according to the invention consists of a portion 1 of a sectional strip of considerable strength and of which the two longitudinal parallel edges are shaped so as to form two attachment ledges 2–3 located in one and the same plane and opposite to each other.

The length of aforesaid section 1 shall generally be equal to or approximating a multiple of the height of the magazine for which the device is intended.

In the lower part of aforesaid section 1, an L-shaped flap 4 is provided with a flanged part 5–6 at each end. The flap is permanently stressed towards its closed position by one or more elastic elements 7. This arrangement is such that aforesaid flap 4, which obstructs the end of section 1, is permanently stressed towards its closed position. As a result hereof, the flap is held stationary in this position in the sense of arrow F1, but remains free to turn in the sense of arrow F2.

In the upper part of section 1, a handle 8 is hingedly attached.

In order permanently to keep ledges 2–3 free, section 1 is provided with a wide channel 9, the side walls 10–11 of which have the free ends of handle 8 passing through them.

In the illustrated example, packages 12 consist for instance of boxes containing cartridge belts. These packages are of overall prismatic shape, each of them being provided, on one side face, with an attachment element. This consists in the present case of a platelet 13 of which the two side edges 14–15 are bent back so as to be slightly spaced from the adjacent side face 16 of the package, thus forming attachment ledges, the spacing being just slightly larger than the wall thickness of aforesaid attachment ledges 2–3. Aforesaid packages 12 are consequently brought into engagement by means of aforesaid ledges 14–15 with aforesaid ledges 2–3, the loading being normally carried out from the top end of the section. The packages are thus slidden on one at a time so as to form a continuous column almost over the entire height of the section 1. In this position, these stacks can easily be handled. The empty packages can be placed back on the support at the end provided with flap 4. On the other hand, after folding back handle 8, these stacks constitute a compact assembly of minimum volume and weight. The mutual attachment elements, consisting respectively of ledges 2–3 of the device and of the bent edges 14–15 of the fixing elements borne by the magazines, are of course essentially variable in shape. The lower flap 4 may also be of any other appropriate shape. With such a device as starting point, it is obvious that numerous alternatives can be built. Such devices might also be attached two by two and back to back, or double assemblies might straightway be built as single units.

What I claim is:

1. A. device for supporting a stack of a plurality of magazines, such as cartridge magazines having a back face and two longitudinal edges, said device comprising: a generally planar back plate having two longitudinal, parallel edges; a U-shaped channel member rigid with and extending along the length of each longitudinal edge of said back plate, the open side of said channels being in opposed relation for receiving the longitudinal edges of said magazine; flap means pivoted to one end of said back plate, said flap means being disposed between said U-shaped channel members and said back plate; spring means continuously urging said flap means to a first closed position providing a wall at said one end of said back plate extending normal thereto wherein it is adapted to support magazines attached to said device, said flap means being pivotable to a second position wherein it permits said magazines to pass it and be removed from said one end of said device; stop means disposed between said flap means and said back plate limiting downward pivotal movement of said flap means to said first position and a handle hingedly mounted at the other end of said back plate.

2. Device according to claim 1, characterized by the flap being located at the bottom end of aforesaid back plate and, aforesaid flap being pivotable upwardly against the load of aforesaid spring to said second position.

3. Device according to claim 2, characterized by said back plate having a length which is equal, or approximately equal to a multiple of the thickness of the magazines to be supported.

4. Device according to claim 1, wherein said back plate is U-shaped and has side walls on which said handle is hingedly mounted.

5. Device for supporting a stack of a plurality of magazines, such as cartridge magazines having a back face and two longitudinal edges, said device being of the type including: a back plate having longitudinal edges which have a U-shaped cross-section; a flap pivoted to one end of said back plate; a spring continuously urging said flap in a predetermined position wherein it supports said magazines the edges of which have been inserted in said U-shaped longitudinal edges and the back faces of which make contact with the outer surface of the back wall of the U-shaped longitudinal edges of said back plate, said flap being able to be pivoted in another position wherein said magazines may be removed from said device; stop means disposed between said flap and said back plate limiting pivotal movement of said flap to said predetermined support position from the other position and a handle hingedly mounted at the other end of said back plate.

6. A device for supporting a stack of a plurality of magazines, such as cartridge magazines having a back face and two longitudinal edges, said device comprising: a generally planar back plate having two longitudinal, parallel edges; a U-shaped channel member rigid with and extending along the length of each longitudinal edge of said back plate, the open side of said channels being in opposed relation for receiving the longitudinal edges of said magazine; flap means pivoted to one end of said back plate, said flap means being disposed between said U-shaped channel members and said back plate; spring means continuously urging said flap means to a first closed position providing a wall at said one end of said back plate extending normal thereto wherein it is adapted to support magazines attached to said device, said flap means being pivotable to a second position wherein it permits said magazines to pass it and be removed from said one end of said device, said back plate having a central depression disposed between said channels and extending along the length of said back plate, the side walls of which support the corresponding ends of the hinged handle.

* * * * *